US005307641A

United States Patent [19]

Kooy

[11] Patent Number: 5,307,641

[45] Date of Patent: May 3, 1994

[54] METHOD AND APPARATUS FOR PRODUCING ICE BY DIRECT CONTACT OF A NON-HYDRATE PRODUCING REFRIGERANT WITH WATER

[75] Inventor: Richard J. Kooy, Western Springs, Ill.

[73] Assignee: Chicago Bridge & Iron Technical Services Company, Oak Brook, Ill.

[21] Appl. No.: 973

[22] Filed: Jan. 6, 1993

[51] Int. Cl.[5] ..... F25D 3/00

[52] U.S. Cl. ..... 62/59; 62/62; 62/63; 62/64

[58] Field of Search ..... 62/59, 62, 63, 64, 533, 62/534

[56] References Cited

U.S. PATENT DOCUMENTS

| | | | |
|---|---|---|---|
| 2,020,719 | 11/1935 | Bottoms . | |
| 3,017,751 | 1/1962 | Hawkins . | |
| 3,017,752 | 1/1962 | Findlay . | |
| 3,247,678 | 4/1966 | Mohlman . | |
| 3,257,818 | 6/1966 | Papapanu . | |
| 3,259,181 | 7/1966 | Ashley et al. . | |
| 3,364,690 | 1/1968 | Torobin . | |
| 3,501,924 | 3/1970 | Ashley . | |
| 3,675,436 | 7/1972 | Ganiaris | 62/533 |
| 3,712,075 | 1/1973 | Smith et al. | 62/534 X |
| 3,813,892 | 6/1974 | Johnson et al. . | |
| 3,835,658 | 9/1974 | Wilson . | |
| 3,838,577 | 10/1974 | Graniaris . | |
| 3,869,870 | 3/1975 | Kuehner . | |
| 3,885,399 | 5/1975 | Campbell . | |
| 3,906,742 | 9/1975 | Newton . | |
| 4,036,619 | 7/1977 | Ganiaris . | |
| 4,046,534 | 9/1977 | Maguire, Sr. . | |
| 4,286,436 | 9/1981 | Engdahl et al. . | |
| 4,452,621 | 6/1984 | Fowles et al. | 62/534 |
| 4,488,407 | 12/1984 | Delano . | |
| 4,540,501 | 9/1985 | Ternes et al. . | |
| 4,584,843 | 4/1986 | Pronger, Jr. et al. . | |
| 4,596,120 | 6/1986 | Knodel et al. . | |
| 4,754,610 | 7/1988 | Knodel et al. . | |
| 4,821,794 | 4/1989 | Tsai et al. | 165/104.17 |
| 4,838,039 | 6/1989 | Knodel . | |
| 4,864,831 | 9/1989 | Hino | 62/534 X |
| 4,914,921 | 4/1990 | Knodel | 62/59 |
| 4,922,998 | 5/1990 | Carr . | |
| 5,054,540 | 10/1991 | Carr . | |
| 5,139,549 | 8/1992 | Knodel et al. | 62/532 |
| 5,140,824 | 8/1992 | Hunt . | |
| 5,218,828 | 6/1993 | Hino | 62/534 X |

FOREIGN PATENT DOCUMENTS

| | | | |
|---|---|---|---|
| 2300468 | 7/1973 | Fed. Rep. of Germany | 62/534 |
| 72783 | 6/1978 | Japan | 62/533 |

OTHER PUBLICATIONS

Naj, *The Wall Street Journal*, "EPA Has Made 11 Alternatives to Refrigerants", Apr. 7, 1992.

Smith, "Estimated Atmospheric Lifetimes of HFCs and HFEs," 1991 International CFC and Halon Alternative Conference, Baltimore Convention Center, Session: Air Conditioning and Refrigeration: New Compounds as Refrigerants II, Hyatt Regency Baltimore, Baltimore, Md., Dec. 5, 1991.

(List continued on next page.)

*Primary Examiner*—Henry A. Bennet
*Assistant Examiner*—Christopher Kilner
*Attorney, Agent, or Firm*—Marshall, O'Toole, Gerstein, Murray & Borun

[57] ABSTRACT

A method comprising feeding a liquefied refrigerant selected from the group consisting of 1,1,1,2,3,3,3-heptafluoropropane; 1,1,1,2,2,3,3-heptafluoropropane; 1,1,1,2,2,3-hexafluoropropane; 1,1,1,3,3,3-hexafluoropropane; perfluorobutane; and octafluoropropane into direct contact with a volume of aqueous liquid in an enclosed ice making vessel to convert part of the aqueous liquid to ice crystals, without the formation of a water-refrigerant hydrate, by vaporizing the refrigerant by heat exchange with the aqueous liquid.

13 Claims, 1 Drawing Sheet

OTHER PUBLICATIONS

Briggs et al., *Advances in Chemistry Series*, 38, pp. 190–199 (1963).

Kopko, "Beyond CFCs: Extending the Search for New Refrigerants," pp. 39–46.

McLinden et al., *ASHRAE Journal*, pp. 69–78 (Dec. 1987).

Mori et al., *AIChE Journal*, 35 (7), pp. 1227–1228 (Jul. 1989).

Skaggs et al., "Research and Development for Total-Flood Halon 1301 Replacements for Oil and Gas Production Facilities," 1991 International CFC and Halon Alternatives Conference, Baltimore Convention Center, Hyatt Regency Baltimore, Baltimore, Md., Dec. 3–5, 1991, pp. 660–666.

Vineyard et al., *ASHRAE Transactions*, 95 (1), pp. 149–161 (1989).

*Water: A Comprehensive Treatise*, Edited by F. Franks (Plenum Press, New York–London, 1973), pp. vi–xv, 122–129.

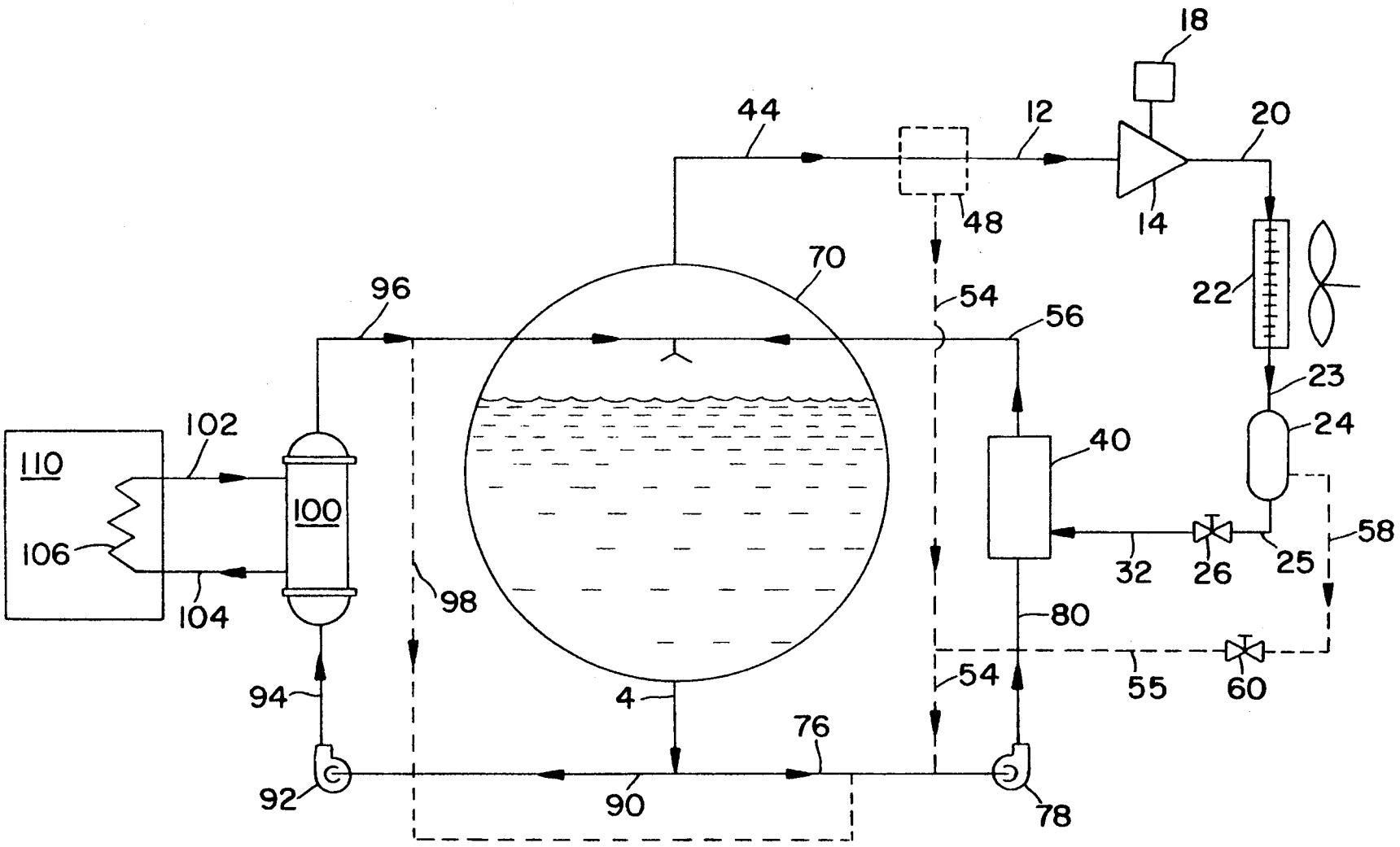
18
20
22
23
24
58
25
60
26
14
32
55
40
12
56
80
78
48
54
54
70
76
44
4
90
98
96
100
94
92
102
104
110
106

METHOD AND APPARATUS FOR PRODUCING ICE BY DIRECT CONTACT OF A NON-HYDRATE PRODUCING REFRIGERANT WITH WATER

This invention relates to methods of producing ice from aqueous liquids. More particularly, this invention is concerned with methods of producing ice by directly contacting an aqueous liquid with a refrigerant.

BACKGROUND OF THE INVENTION

The production of ice in aqueous liquids has many useful purposes. Ice can be produced and used immediately, or the ice can be stored and used later, for example, for cooling purposes. Also, in the production of potable water, sea water and brackish water can be cooled to produce ice, the ice separated and then melted to give the desired fresh water. Fruit and vegetable juices are also concentrated by cooling them to produce ice and then separating the ice from the concentrated juice.

The production of ice for the described purposes, as well as others, can be achieved in a number of ways including indirect heat transfer in a shell and tube freeze exchanger. A refrigerant can be used as the cooling medium on the shell side of the freeze exchanger. This method is disclosed in U.S. Pat. No. 4,286,436.

Another method of producing ice is to directly contact the aqueous liquid with a refrigerant. Direct contact heat transfer typically permits the use of a smaller temperature difference between the vaporizing refrigerant and freezing solution than is required by an indirect heat transfer system to achieve the same energy transfer, due to the elimination of the heat exchanger surface. However, the exact temperature difference required in the direct contact heat exchanger will depend upon several factors including the properties of the two fluids, the ratio of the two fluids and agitation. This method, as well as apparatus useful therefore, is disclosed in U.S. Pat. Nos. 3,017,751; 3,017,752; 3,259,181; 3,835,658; 3,885,399 and 4,046,534. After the ice is produced it is separated and then discarded, melted and used as potable water, or melted to recover stored refrigeration. The refrigerant used for cooling and ice formation is recovered to the extent possible and then reused in the process.

Experience has shown that in direct contact methods a significant amount of refrigerant vapor and liquid can be encapsulated or entrapped in the aqueous solution, either by gross inclusion in the ice crystals or by the formation of clathrate hydrates. When the ice or hydrate is later melted or disposed of, some or most of the encapsulated refrigerant may be difficult to recover. Additionally, encapsulation of the refrigerant constitutes a economic penalty because the amount of refrigerant required for continuous operation is substantially increased. Accordingly, it is desirable in the production of ice, by directly contacting an aqueous liquid with a refrigerant, if refrigerant capsulation in the water or ice could be reduced. Thus, only select chemical refrigerants are desirably used in direct contact heat transfer aqueous processes.

Many chemical refrigerants form clathrate hydrates with water at temperatures substantially above 32.0° F. (0.0° C). For example, chlorodifluoroethane ($CH_3CClF_2$), commonly designated HCFC-142b, and 1,1-difluoroethane ($CHF_2CH_3$), commonly designated HFC-152a, form hydrates with water at 56° F. (13.1° C.) and 60° F. (15.3° C.) respectively per Briggs, F.A. and Barduhn, A.J. "Properties of the Hydrates of Fluorocarbons 142b and 12B1", Advances in Chemistry Series, American Chemical Society, No. 38, pp. 190–199, 1963. Also, 1,1,1,2-tetrafluoroethane ($CH_2FCF_3$), commonly designated HFC-134a, forms a hydrate with water at 50° F. (10° C.) per Mori, Yasuhiko H., and Mori, Tatsushi, "Formation of Gas Hydrate with CFC Alternative R-134a", AlChE Journal, Vol. 35, No. 7, July 1989, pp.1227–1228. Other chemical refrigerants which form hydrates are bromodifluoromethane ($CHBrF_2$; HBFC-22B1) (50.0° F.; 9.9° C.); bromochlorodifluoromethane ($CBrClF_2$; BCFC-12B1) (50.0° F.; 9.9° C.); methylene fluoride ($CH_2F_2$; HFC-32) (63.7° F.; 17.6° C.); chlorofluoromethane ($CH_2ClF$; HCFC-31) (64.1° F.; 17.8° C.); chlorodifluoromethane ($CHClF_2$; HCFC-22) (61.3° F.; 16.3° C.); dichlorofluoromethane ($CHCl_2F$; HCFC-21) (47.5° F.; 8.6° C.); dichlorodifluoromethane ($CCl_2F_2$; CFC-12) (53.8° F.; 12.1° C.); trichlorofluoromethane ($CCl_3F$; CFC-11) (47.3° F.; 8.5° C.); cyclopropane ($CH_2CH_2CH_2$; C-270) (63° F.; 17.2° C.); propylene ($CH_2{=}CHCH_3$; C-1270) (33.7° F.; 0.94° C.); and methyl chloride ($CH_3Cl$; R-40) (70.0° F.; 21.1° C.), per Briggs and Barduhn (above) and *Water: A Comprehensive Treatise, Volume* 2, edited by F. Franks (Plenum Press, New York, 1973).

It is often advantageous if the chemical refrigerant used in a direct contact heat transfer process has a normal boiling point less than 32.0° F. (0.0° C.). In a process such as that described by Knodel et al in U.S. Pat. No. 4,596,120 the ice is accumulated in a vessel which operates essentially at the refrigerant evaporating pressure. If the refrigerant has a normal boiling point less than 32.0° F. (0.0° C.), than the vessel operates above atmospheric pressure, and the potential of air in leakage is minimized. This is of particular importance since large commercial systems typically require a number of field assemblies and joints.

Additionally, it is considered advantageous if chemical refrigerants do not contain the chemical element chlorine, as recent world environmental agreements have restricted the production and use of certain chlorine-bearing compounds, in an effort to protect the earth's stratospheric ozone layer.

Knodel et al U.S. Pat. No. 4,754,610 discloses refrigerants useful in that process and which do not form hydrates or react with an aqueous body. Those refrigerants include butane (R-600), octafluorocyclobutane (C-318), 1,2-dichlorotetrafluoroethane (CFC-114), and a mixture of CFC-114 and dichlorodifluoromethane (CFC-12) where less than 40% by weight of the mixture is CFC-12. Some of these listed refrigerants are flammable and some are considered to be environmentally harmful, and so their use will be prohibited in some countries before long. Apart from these disadvantages it would be beneficial in the art of ice making by direct contact of a liquefied refrigerant with an aqueous liquid if one could be able to select an alternative or substitute refrigerant from a group which it was known did not form clathrate hydrates to thereby design an optimum process for the conditions otherwise involved in the process.

SUMMARY OF THE INVENTION

According to the invention a method is provided comprising feeding a liquefied refrigerant selected from the group consisting of:

| | | |
|---|---|---|
| 1. | 1,1,1,2,3,3,3-heptafluoropropane<br>HFC-227ea $CF_3—CHF—CF_3$ | NBP* = −0.40° F. |
| 2. | 1,1,1,2,2,3,3-heptafluoropropane<br>HFC-227ca $CF_3—CF_2—CF_2H$ | NBP = 1.40° F. |
| 3. | 1,1,1,2,2,3-hexalfuoropropane<br>HFC-236cb $CF_3—CF_2—CFH_2$ | NBP = 29.4° F. |
| 4. | 1,1,1,3,3,3-hexafluoropropane<br>HFC-236fa $CF_3—CH_2—CF_3$ | NBP = 30.7° F. |
| 5. | Perfluorobutane<br>FC-31.10 $CF_3—CF_2—CF_2—CF_3$ | NBP = 23.0° F. |
| 6. | Octafluoropropane<br>FC-218 $CF_3—CF_2—CF_3$ | NBP = −38.2° F. |

*NBP = normal boiling point (approximate)

into direct contact with a volume of aqueous liquid in an enclosed ice making vessel to convert part of the aqueous liquid to ice crystals, without the formation of a water-refrigerant hydrate, and vaporizing the refrigerant by heat exchange with the aqueous liquid.

The vaporized refrigerant can be separated from the aqueous liquid containing ice crystals, the refrigerant vapor can be reliquefied, and the liquefied refrigerant again fed to a volume of the aqueous liquid to make more ice.

BRIEF DESCRIPTION OF THE DRAWING

The attached schematic drawing illustrates an apparatus useful in practicing the invention.

DETAILED DESCRIPTION OF THE DRAWING

With reference to the drawing, the combination of apparatus illustrated schematically in that drawing includes a refrigerant compressor 14 driven by electric motor 18, a refrigerant condenser 22, receiver 24 and expansion valve 26. Refrigerant vapor is supplied to compressor 14 by conduit 12. Compressed refrigerant vapor exits compressor 14 into conduit 20 which feeds it to condenser 22 in which it is cooled and liquefied. The liquid refrigerant under high pressure exits condenser 22 into conduit 23 which feeds it to receiver 24. The liquid refrigerant exits the receiver 24 into conduit 25 which feeds it to flow control device 26. The refrigerant exits flow control device 26 into conduit 32 which feeds it to vessel 40.

Any refrigerant identified above is preferably used in the described system.

Conduit 32 can project inside of vessel 40 and be provided with a plurality of holes through which the refrigerant can flow out into direct contact with the volume of aqueous liquid in the vessel 40. Expansion of the refrigerant to the evaporating pressure can occur across the nozzles or the plurality of holes. As a result of heat exchange from the water to the refrigerant, the aqueous liquid is cooled while the refrigerant vaporizes. A mixture of ice crystals and aqueous liquid and refrigerant is withdrawn from vessel 40 by conduit 56 and fed to storage tank 70.

Refrigerant vapor containing water is removed from storage tank 70 by conduit 44 and delivered to refrigerant dewatering vessel 48 in which the refrigerant vapor is essentially freed of water. The dewatered refrigerant vapor is removed from vessel 48 by conduit 12 for delivery to compressor 14. Water separated in dewatering vessel 48 is withdrawn therefrom by conduit 54 and returned to vessel 40 through pump 78 and conduit 80. Alternatively, condensed water vapor may be removed from refrigerant receiver 24. Water can be fed from receiver 24 through conduit 58, pressure reducing valve 60 and conduit 55 to pump 78. Conduit 80 receives the water from the pump and delivers it to vessel 40.

Aqueous liquid is withdrawn from the bottom of tank 70 through conduits 4,76 and fed through pump 78 to conduit 80 which recycles the liquid to vessel 40 to be further cooled.

The described method can be used to produce ice for cooling purposes. Thus, it can be operated as long as desired to produce as little or as much ice for storage as may be suitable for particular circumstances. When ice is produced it generally will proceed until the ice storage tank 70 is one-half to three-fourths full of ice with the balance liquid. Thus, enough ice can be produced to have it approach the tank bottom. Since aqueous liquid flows through the ice, liquid can be withdrawn readily from the tank bottom. For most economical ice making, the apparatus is operated for ice making when electricity rates are the lowest, i.e. at off-peak periods, which usually are evenings and weekends.

The cooling capacity of the cold aqueous liquid and ice can be utilized for any cooling purpose, including air conditioning. Thus, cold aqueous liquid can be withdrawn from tank 70 by conduits 4,90 and fed to pump 92 powered by an electric motor (not shown). The cold aqueous liquid is fed from pump 92 to conduit 94 which feeds it to heat exchanger 100. The cold aqueous liquid flows in indirect heat exchange with a warm fluid supplied by conduit 102 to heat exchanger 100. The aqueous liquid, thereby warmed, is withdrawn from the heat exchanger 100 by conduit 96 and fed into the top of tank 70. Aqueous liquid can be withdrawn at the bottom as cold liquid. Alternatively, the warm aqueous liquid can be fed from conduit 96 to conduit 98, shown as a dashed line, and then delivered through conduit 76, pump 78 and conduit 80 to ice making vessel 40 to be cooled again.

The warm fluid supplied by conduit 102 to heat exchanger 100 is removed therefrom as cold fluid by conduit 104 and circulated through cooling coil 106 in facility or load 110 to provide the necessary cooling or refrigeration.

This system can continue to operate so long as ice is available in the storage tank 70. Desirably, the amount of ice in the tank available for cooling should be adequate for the intended cooling purpose.

The described ice making and storage apparatus can be operated at any time, whether during on-peak or off-peak periods of electrical usage. It is generally less expensive, and thus economically advantageous, to produce ice during off-peak periods of electrical consumption when the electricity rates are low. The cooling capacity stored in the form of ice can then be used during on-peak periods for industrial cooling and refrigeration purposes. The ice can also be removed, melted and the water used as potable water.

EXAMPLE

Refrigerant 1,1,1,2,3,3,3-heptafluoropropane ($CF_3$-CHF-$CF_3$ or HFC-227ea) is mixed in direct contact in an enclosed vessel with a volume of pure water at 32.0° F. (0° C.). If the evaporating temperature differential is 7.0° F. (3.9° C.), then the refrigerant evaporates at 25.0° F. (−3.9° C.) as ice is formed in the water. The pressure in the vessel is essentially the refrigerant saturation pressure at 25.0° F., which is 25.4 psia (175 kPa). Saturated refrigerant vapor (with small amounts of water) can be withdrawn and reliquefied to continue the process.

What is claimed is:

1. A method comprising:

feeding a liquefied refrigerant selected from the group consisting of:

1,1,1,2,3,3,3-heptafluoropropane
1,1,1,2,2,3,3-heptafluoropropane
1,1,1,2,2,3-hexafluoropropane
1,1,1,3,3,3-hexafluoropropane
Octafluoropropane into direct contact with a volume of aqueous liquid in an enclosed ice making vessel to convert part of the aqueous liquid to ice crystals, without the formation of a water. refrigerant hydrate, by vaporizing the refrigerant by heat exchange with the aqueous liquid.

2. A method according to claim I in which the vaporized refrigerant is separated from the aqueous liquid containing ice crystals, the refrigerant vapor is reliquefied, and the liquefied refrigerant is again fed to a volume of the aqueous liquid.

3. A method according to claim 1 in which:
the refrigerant is 1,1,1,2,3,3,3-heptafluoropropane.

4. A method according to claim 1 in which:
the refrigerant is 1,1,1,2,2,3,3-heptafluoropropane.

5. A method according to claim 1 in which:
the refrigerant is 1,1,1,2,2,3-hexafluoropropane.

6. A method according to claim 1 in which:
the refrigerant is 1,1,1,3,3,3-hexafluoropropane.

7. A method according to claim 1 in which:
the refrigerant is octafluoropropane.

8. A method comprising:

feeding a liquefied refrigerant selected from the group consisting of:

1,1,1,2,3,3,3-heptafluoropropane
1,1,1,2,2,3,3-heptafluoropropane
1,1,1,2,2,3-hexafluoropropane
1,1,1,3,3,3-hexafluoropropane
Octafluoropropane into direct contact with a volume of aqueous liquid in an enclosed ice making vessel to convert part of the aqueous liquid to ice crystals and vaporize the refrigerant by heat exchange with the aqueous liquid;

separating a mixture of aqueous liquid and ice crystals from the refrigerant vapor and feeding said mixture to a tank;

converting the refrigerant vapor to liquid refrigerant in a refrigeration cycle and feeding the liquid refrigerant back to the ice making vessel; and withdrawing aqueous liquid from the tank and feeding it to the ice making vessel.

9. A method according to claim 8 in which:
the refrigerant is 1,1,1,2,3,3,3-heptafluoropropane.

10. A method according to claim 8 in which:
the refrigerant is 1,1,1,2,2,3,3-heptafluoropropane.

11. A method according to claim 8 in which:
the refrigerant is 1,1,1,2,2,3-heptafluoropropane.

12. A method according to claim 8 in which:
the refrigerant is 1,1,1,3,3,3-heptafluoropropane.

13. A method according to claim 8 in which:
the refrigerant is octafluoropropane.

* * * * *

UNITED STATES PATENT AND TRADEMARK OFFICE

CERTIFICATE OF CORRECTION

PATENT NO. : 5,307,641

DATED : May 3, 1994

INVENTOR : RICHARD JOHN KOOY

It is certified that error appears in the above-identified patent and that said Letters Patent is hereby corrected as shown below:

Col. 3, line 6, (3.) "hexalfuoropropane" should be --hexafluoropropane--.

Col. 5, line 13, "water.refrigerant" should be --water-refrigerant--.

Col. 5, line 15, "claim I" should be "claim 1".

Col. 6, line 25, "heptafluoropropane" should be --hexafluoropropane--.

Col. 6, line 27, "heptafluoropropane" should be --hexafluoropropane--.

Signed and Sealed this

Thirtieth Day of August, 1994

*Attest:*

Bruce Lehman

BRUCE LEHMAN

*Attesting Officer*

*Commissioner of Patents and Trademarks*